US009895597B2

(12) United States Patent
Suda

(10) Patent No.: US 9,895,597 B2
(45) Date of Patent: Feb. 20, 2018

(54) SNOWBOARD BINDING AND STOPPER DEVICE FOR SNOWBOARD BINDING

(71) Applicant: NEO SNOW RENTAL INC., Minami-Uonuma-gun, Niigata (JP)

(72) Inventor: Kentaro Suda, Yuzawa-machi (JP)

(73) Assignee: XEBRA INC., Niigata (JP)

( * ) Notice: Subject to any disclaimer, the term of this patent is extended or adjusted under 35 U.S.C. 154(b) by 0 days.

(21) Appl. No.: 15/318,998

(22) PCT Filed: Oct. 30, 2015

(86) PCT No.: PCT/JP2015/080768
§ 371 (c)(1),
(2) Date: Dec. 15, 2016

(87) PCT Pub. No.: WO2017/017861
PCT Pub. Date: Feb. 2, 2017

(65) Prior Publication Data

US 2017/0209772 A1 Jul. 27, 2017

(30) Foreign Application Priority Data

Jul. 24, 2015 (JP) ..... 2015-146690

(51) Int. Cl.
*A63C 10/00* (2012.01)
*A63C 10/24* (2012.01)
*A63C 10/06* (2012.01)

(52) U.S. Cl.
CPC ..... *A63C 10/24* (2013.01); *A63C 10/06* (2013.01)

(58) Field of Classification Search
CPC ..... A63C 10/24; A63C 10/28; A63C 10/06; A63C 10/045; A63C 10/12; A63C 10/00; A63C 7/00; A63C 7/1066
See application file for complete search history.

(56) References Cited

U.S. PATENT DOCUMENTS 3,781,026 A * 12/1973 Bovee ..... A63C 7/108 280/605
5,816,602 A * 10/1998 Hayashi ..... A63C 10/28 280/14.21

(Continued)

FOREIGN PATENT DOCUMENTS

JP 10-314364 A 12/1998
JP 2832783 B2 12/1998

(Continued)

OTHER PUBLICATIONS

Written Opinion issued by the International Bureau in corresponding International Application No. PCT/JP2015/080768, dated Mar. 6, 2017.

(Continued)

*Primary Examiner* — James A Shriver, II
*Assistant Examiner* — Steve Clemmons
(74) *Attorney, Agent, or Firm* — Sughrue Mion, PLLC

(57) ABSTRACT

Provided is a snowboard binding in which a stopper function operates when a boot is removed and the stopper function is released when a boot is mounted, and a stopper device for a snowboard binding. The snowboard binding is provided with an urging body for rotatably urging a highback rearward, and configured so that when a lock lever of a lock mechanism is placed in an unlocked state by the rotational urging of the urging body, the highback automatically rotates rearward, and configured so that when the highback arrives at the rearward-rotation-limit position or near the rearward-rotation-limit position, a connecting cord of the lock mechanism is tensioned, the orientation in which the lock lever projects from the highback rear surface section is maintained, and the lock lever in this projecting orientation makes contact with the snow surface below a snowboard to bring about a slide-preventing effect.

5 Claims, 7 Drawing Sheets

(56) References Cited

U.S. PATENT DOCUMENTS

| | | | | |
|---|---|---|---|---|
| 6,003,893 | A * | 12/1999 | Hansen | A63C 10/04 280/14.21 |
| 6,007,077 | A * | 12/1999 | Moe | A63C 10/045 280/14.22 |
| 7,246,811 | B2 * | 7/2007 | Martin | A63C 10/04 280/14.22 |
| 7,367,579 | B2 * | 5/2008 | Elkington | A63C 10/04 280/11.3 |
| 8,016,315 | B2 * | 9/2011 | Neiley | A63C 10/04 280/611 |
| 8,646,800 | B2 * | 2/2014 | Bertagnolio | A63C 7/1066 280/605 |
| 9,205,321 | B2 * | 12/2015 | Geiger | A63C 10/28 |
| 9,545,560 | B2 * | 1/2017 | Chen | B63B 35/812 |
| 2002/0175497 | A1 * | 11/2002 | Freemon | A63C 10/28 280/605 |
| 2007/0075524 | A1 * | 4/2007 | Kelly | A63C 10/28 280/605 |

FOREIGN PATENT DOCUMENTS

| | | | |
|---|---|---|---|
| JP | 2012-513281 | A | 6/2012 |
| WO | 2009/075837 | A1 | 6/2009 |

OTHER PUBLICATIONS

Office Action of Japanese Application No. 2015-146690 dated Aug. 24, 2016.

Notification of Allowance of Japanese Application No. 2015-146690 dated Nov. 10, 2016.

International Search Report of PCT/JP2015/080768 dated Jan. 19, 2016 [PCT/ISA/210].

Written Opinion of PCT/JP2015/080768 dated Jan. 19, 2016 [PCT/ISA/237].

* cited by examiner

SNOWBOARD BINDING AND STOPPER DEVICE FOR SNOWBOARD BINDING

TECHNICAL FIELD

The present invention relates to a snowboard binding and a stopper device for a snowboard binding in which a stopper (slide prevention) function of a snowboard works in cooperation with an operation for removing a boot.

BACKGROUND ART

Japanese Patent No. 2832783 (Patent Document 1) is an example of a conventional snowboard binding.

First Patent Document 1 shall be briefly described. The invention comprises a base plate, a highback in which the lower portion thereof is tiltably and pivotably mounted on the base plate, a strap section in which the lower end section thereof is attached to the portion that extends further downward than the pivotably mounted section of the highback, and unlockable locking means for locking the rearward tilt of the highback, the locking means being composed of a wire that extends along the back surface of the highback, the two ends of the wire being linked to both sides of the base plate portion further forward than the pivotably mounted section of the highback, and a lever that is rotatably and pivotably mounted on the highback and that is operated to switch the wire between a state of tension a state of non-tension.

According to Patent Document 1, there are advantages in that the highback is tilted rearward by releasing the lock with a lever operation to allow a boot to be very readily detached from the baseboard without disengaging the ratchet and ratchet belt of the strap section, and the fastening arrangement of the boot can be the same each time.

PRIOR ART DOCUMENTS

Patent Documents

[Patent Document 1] Japanese Patent No. 2832783

DISCLOSURE OF THE INVENTION

Problems that Invention is to Solve

A slide-preventing band referred to as a tether which is wound around a leg is provided to a snowboard binding.

However, the tether is bothersome in that the operation for mounting to/dismounting from a foot must be carried out separately from the operation for mounting/dismounting a boot to the binding, and since the appearance of the tether wound about a leg may be considered to be poor, the use of the tether has been inconsistent.

Accordingly, there is a persistent problem of accidents that occur when an un-tethered snowboard slides down the ski slope and collides with other skiers and snowboarders, and since the stopper function does not automatically function when a boot is removed from the binding as does the stopper for a ski, the snowboard may slide down the ski slope when the boots are being mounted/dismounted (when both feet are removed from the binding), and a snowboard leaning up against a stand may accidentally fall down due to wind or other factor and then slide down the ski slope.

In view of the problems associated with preventing such snowboard sliding, the present invention was devised to solve such problems, it being an object thereof to improve a highback rearward-tiltable-type binding such as Patent Document 1 and thereby provide a snowboard binding in which the stopper function operates in cooperation with the action of removing a boot in the same manner as a ski stopper, and a stopper device for a snowboard binding that demonstrates the stopper function by being attached to the binding of a highback rearward-tiltable-type binding.

Means of Solving the Problems

The main points of the present invention are described below with reference to the attached drawings.

The present invention relates to a snowboard binding A comprising a base section 3 attached to a snowboard 1 and allowing a boot 2 to be mounted thereon, a highback 4 pivotably mounted on a rear part of the base section 3 and capable of rotating in the longitudinal direction with respect to the base section 3, a strap 5 provided in a position of the base section 3 further frontward than the highback 4, and an unlockable lock mechanism 6 for locking the highback 4 in a state in which rearward rotation is impossible, the lock mechanism 6 having a lock lever 7 rotatably provided to a rear surface section of the highback 4 and a connecting cord 8 provided so as to span between the lock lever 7 and the base section 3, and being configured so that when the lock lever 7 is extended along the rear surface section of the highback 4 by a rotating operation, the connecting cord 8 is tensioned and the highback 4 is placed in a locked state in which rearward rotation is impossible, and so that when the lock lever 7 in the locked state is caused to project rearward from the rear surface section of the highback 4 by the rotation operation the connecting cord 8 slackens and the highback 4 is placed in an unlocked state in which rearward rotation is possible; the snowboard binding characterized in that an urging body 9 for rotatably urging the highback 4 rearward is provided to the highback 4, and in being configured so that when the lock lever 7 of the lock mechanism 6 is placed in an unlocked state by the rotatable urging of the urging body 9, the highback 4 automatically rotates rearward, and so that when the highback 4 arrives at the rearward-rotation-limit position or near the rearward-rotation-limit position, the connecting cord 8 is tensioned, the orientation at which the lock lever 7 projects from the highback 4 rear surface section is maintained, and the lock lever 7 in the projecting orientation makes contact with the snow surface S below the snowboard 1 to bring about a slide-preventing effect.

The present invention relates to the snowboard binding according to the first aspect, characterized in that the lock lever 7 is formed into a shape having a tip operation part 11 that allows the lock lever 7 to be rotatably operated, and is formed into a shape in which the tip operation part 11 of the lock lever 7 protrudes below the lower surface of the snowboard 1 and makes contact with the snow surface S below the snowboard 1 when the highback 4 arrives at the rearward-rotation-limit position or near the rearward-rotation-limit position due to the rotational urging of the urging body 9 with the lock lever 7 in a state of being caused to project rearward from the rear surface of the highback 4.

The present invention relates to the snowboard binding according to the first or second aspect, characterized in being configured so that a lever-holding body 10 for holding the unlocked lock lever 7 in an orientation in which the lock lever is caused to project rearward from the rear surface section of the highback 4 is provided to the highback 4, and so that the tip operation part 11 of the lock lever 7 held in the orientation of projecting from the rear surface section of the highback 4 by the lever-holding body 10 protrudes downward when the highback 4 arrives at the rearward-rotation-limit position or near the rearward-rotation-limit position due to the urging body 9.

The present invention relates to the snowboard binding according to the first or second aspect, characterized in being configured so that the urging body 9 is provided so as to span between the highback 4 and the base section 3, and the urging body 9 rotatably urges the highback 4 rearward.

The present invention relates to the snowboard binding according to the third aspect, characterized in being configured so that the urging body 9 is provided so as to span between the highback 4 and the base section 3, and the urging body 9 rotatably urges the highback 4 rearward.

The present invention relates to a stopper device for a snowboard binding for attachment to and usage in a snowboard binding A comprising a base section 3 attached to a snowboard 1 and allowing a boot 2 to be mounted thereon, a highback 4 pivotably mounted on a rear part of the base section 3 and capable of rotating in the longitudinal direction with respect to the base section 3, a strap 5 provided in a position of the base section 3 further frontward than the highback 4, and an unlockable lock mechanism 6 for locking the highback 4 in a state in which rearward rotation is impossible, the lock mechanism 6 having a lock lever 7 rotatably provided to a rear surface section of the highback 4 and a connecting cord 8 provided so as to span between the lock lever 7 and the base section 3, and being configured so that when the lock lever 7 is extended along the rear surface section of the highback 4 by a rotating operation, the connecting cord 8 is tensioned and the highback 4 is placed in a locked state in which rearward rotation is impossible, and so that when the lock lever 7 in the locked state is caused to project rearward from the rear surface section of the highback 4 by the rotation operation, the connecting cord 8 slackens and the highback 4 is placed in an unlocked state in which rearward rotation is possible; the stopper device for a snowboard binding characterized in being provided with an urging body 9 that can be attached to the highback 4 and that rotatably urges the highback 4 rearward.

The present invention relates to the stopper device for a snowboard binding according to the sixth aspect, characterized in being configured so that the urging body 9 is provided with an attachment section 12 that allows attachment to the base section 3 and the highback 4 at both ends, and the urging body 9 is allowed to be attached so as to span between the base section 3 and the highback 4 due to the attachment section 12.

The present invention relates to the stopper device for a snowboard binding according to the sixth or seventh aspect, characterized in being provided with a lever-holding body 10 that can be attached to the rear surface section of the highback 4 and that holds the unlocked lock lever 7 in an orientation in which the lock lever is caused to project rearward from the rear surface section of the highback 4, and in being configured so that the tip operation part 11 of the lock lever 7 held in the orientation of projecting from the rear surface section of the highback 4 by the lever-holding body 10 protrudes downward when the highback 4 arrives at the rearward-rotation-limit position or near the rearward-rotation-limit position due to the urging body 9.

Effects of the Invention

The present invention is configured in the manner described above and therefore has, in addition to the same effects as Patent Document 1, the effect of making the process of winding a bothersome tether around the legs unnecessary, and is capable of demonstrating a slide-preventing effect in that merely by rotating the lock lever of a lock mechanism on the highback in order to remove the boots, the highback automatically rotates rearward, and the lock lever makes contact with the snow surface.

In other words, a slide-preventing effect can be demonstrated in the same manner as a ski stopper while the boots are being removed from the binding, resulting in a very practical snowboard binding in which it is possible to reliably prevent accidents where the snowboard slides down the ski slope by itself and collides with other skiers and snowboarders.

The invention according to the second aspect provides a snowboard binding having a configuration with an even higher level of practicality in that a lock lever that reliably makes contact with the snow surface to be capable of demonstrating an effect for preventing the snowboard from sliding can be readily designed and implemented using a simple configuration.

The invention according to the third aspect provides a snowboard binding having a configuration with an even higher level of practicality in that the configuration in which the lock lever makes reliable contact with the snow surface to demonstrate an effect for preventing the snowboard from sliding can be readily designed and implemented using a simple configuration.

The inventions according to the fourth and fifth aspects provide a snowboard binding having a configuration with an even higher level of practicality in that the configuration in which the lock lever is operated and placed in an unlocked state whereby the highback is automatically rotated rearward can be readily designed and implemented using a simple configuration.

The invention according to the sixth aspect provides a stopper device for a snowboard binding having a very high level of practicality in being capable of being attached (retrofitted) to an existing snowboard binding and thereby demonstrating the same effect as the first aspect.

The invention according to the seventh aspect provides a stopper device for a snowboard binding having a configuration with an even higher level of practicality in that the configuration in which an urging body can be readily attached to the base section and the highback, the lock lever is operated to obtain an unlocked state, and the highback is thereby automatically rotated rearward, can be readily designed and implemented using a simple configuration.

The invention according to an eighth aspect provides a stopper device for a snowboard binding having a configuration with an even higher level of practicality in that the configuration in which the lock lever makes reliable contact with the snow surface to demonstrate an effect for preventing the snowboard from sliding can be readily designed and implemented using a simple configuration.

BEST MODE FOR CARRYING OUT THE INVENTION

Figure 1:
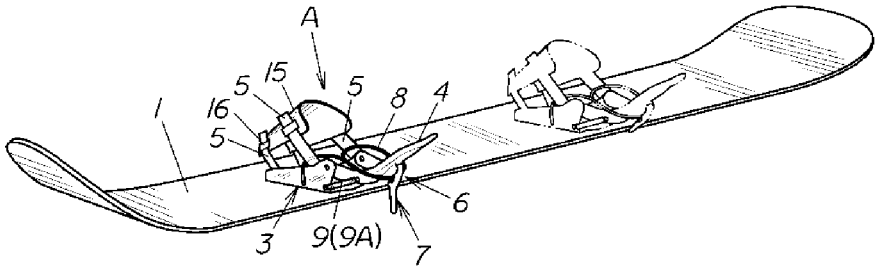
FIG. 1 is a schematic perspective diagram showing the usage state of example 1.

Preferred embodiments of the present invention are briefly described below with reference to the diagrams while indicating the effects of the present invention.

The snowboard binding A of the present invention (first aspect) has a highback 4 in the rear part of a base section 3 that is rotatably and pivotably mounted in the longitudinal direction, and the highback 4 is locked in a state in which rearward rotation is impossible by a lock mechanism 6 while a boot 2 is worn.

Specifically, a lock lever 7 rotatably provided to the rear surface section of the highback 4 is rotatably operated, and when the lock lever 7 is extended along the rear surface section of the highback 4, a connecting cord 8 provided so as to span between the lock lever 7 and the base section 3 is tensioned, the highback 4 is placed in a locked state in which rearward rotation is impossible, and the boot 2 placed on the base section 3 is bound to the base section 3 by the highback 4 and a strap 5 provided in a more front-side position of the base section 3 than the highback 4 (resulting in a state in which the boot 2 is worn.

When the boot 2 is to be removed from the binding A, the lock mechanism 6 is unlocked and rotated so as to tilt the highback 4 rearward.

Specifically, when the lock lever 7 extended along the rear surface section of the highback 4 (maintaining the locked state) is rotatably operated so as to be caused to project rearward from the rear surface section of the highback 4, the connecting cord 8 slackens and the highback 4 is placed in an unlocked state in which rearward rotation is possible.

The highback 4, when placed in an unlocked state, automatically rotates rearward by the rotatable urging of an urging body 9 provided to the highback 4, and when the highback 4 automatically rotates rearward, and so that when the highback 4 arrives at the rearward-rotation-limit position or near the rearward-rotation-limit position, the connecting cord 8 is tensioned, the projecting orientation of the lock lever 7 from the highback 4 rear surface section is maintained, and the lock lever 7 in the projecting orientation makes contact with the snow surface S below the snowboard 1 to bring about a slide-preventing effect.

Therefore, when the lock lever 7 is rotatably operated to the unlocked state in order to remove the boot 2, an effect for preventing the snowboard 1 from sliding brought about by the lock lever 7 is automatically demonstrated. Accordingly, the process for winding a bothersome tether about the leg is not required, and there is no poor appearance of the tether winding.

When the highback 4 is rotated rearward, the boot 2 is allowed to move rearward in relation to the base section 3, and the boot 2 is allowed to move to the rearward position unrestrained by the strap 5, whereby the boot 2 can be removed from the base section 3.

Therefore, the boot 2 can be mounted to or dismounted from the base section 3 without removing the strap 5, and once the state of restraint of the boot by the strap 5 has been adjusted, the same state of restraint of the boot 2 can be created each usage without the process for adjustment each time the boot 2 is mounted/dismounted.

When the boot 2 is to be remounted, the boot 2 is placed on the base section 3, and the highback 4 is rotated forward against the urging force of the urging body 9 and brought into line with the rear section of the boot 2 to produce the locked state. Therefore, the lock lever 7 can be separated from the snow surface S and the slide-preventing state released.

In other words, a slide-preventing effect is demonstrated while the boot 2 is being removed from the binding A in similar fashion to a ski stopper, and it is therefore possible to prevent the snowboard 1 from sliding down the ski slope without a tether attachment, to prevent the snowboard 1 from sliding down the ski slope when the boots 2 are mounted or dismounted (when both feet are removed from the binding), and to prevent a snowboard 1 leaning up against a stand from accidentally falling down due to wind or other factor and then slide down the ski slope. It is thereby possible to avoid accidents in which an uncontrolled snowboard 1 collides with other skiers and snowboarders.

With the stopper device for a snowboard binding of the present invention (sixth aspect), an urging body 9 can be attached to the highback 4 in a well-known snowboard binding A comprising a base section 3 attached to a snowboard 1 and on which a boot 2 can be mounted, a highback 4 pivotably mounted on a rear part of the base section 3 and capable of rotating in the longitudinal direction with respect to the base section 3, a strap 5 provided in a more front-side position of the base section 3 than the highback 4, and an unlockable lock mechanism 6 for locking the highback 4 in a state in which rearward rotation is impossible, the lock mechanism having a lock lever 7 rotatably provided to a rear surface section of the highback 4 and a connecting cord 8 provided so as to span between the lock lever 7 and the base section 3, and being configured so that when the lock lever 7 is extended along the rear surface section of the highback 4 by a rotating operation, the connecting cord 8 is tensioned and the highback 4 is placed in a locked state in which rearward rotation is impossible, and so that when the lock lever 7 in the locked state is caused to project rearward from the rear surface section of the highback 4 by the rotation operation 4, the connecting cord 8 slackens and the highback 4 is placed in an unlocked state in which rearward rotation is possible.

At this point, the same effect as the snowboard binding A of the first aspect described above can be demonstrated by the rotatable urging of the highback 4 imparted by the urging body 9.

Example 1

Specific examples of the present invention are described below with reference to the FIGS. 1 to 5.

The present example is applied to a binding A for mounting a front foot of a left and right pair of snowboard bindings.

Figure 2:
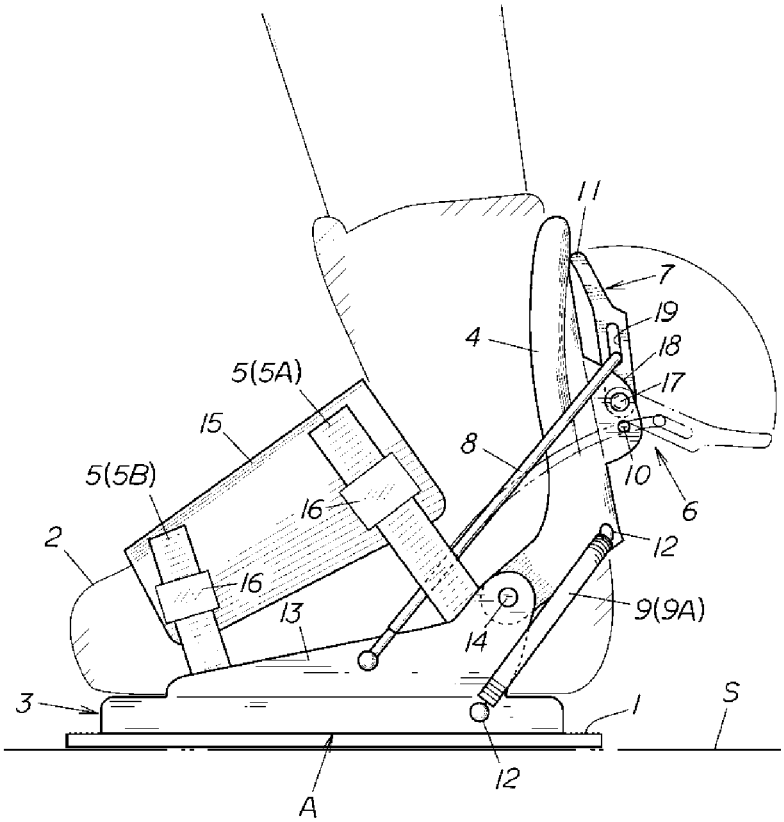
FIG. 2 is a side view illustrating the worn-state of the boot of example 1.
Figure 3:
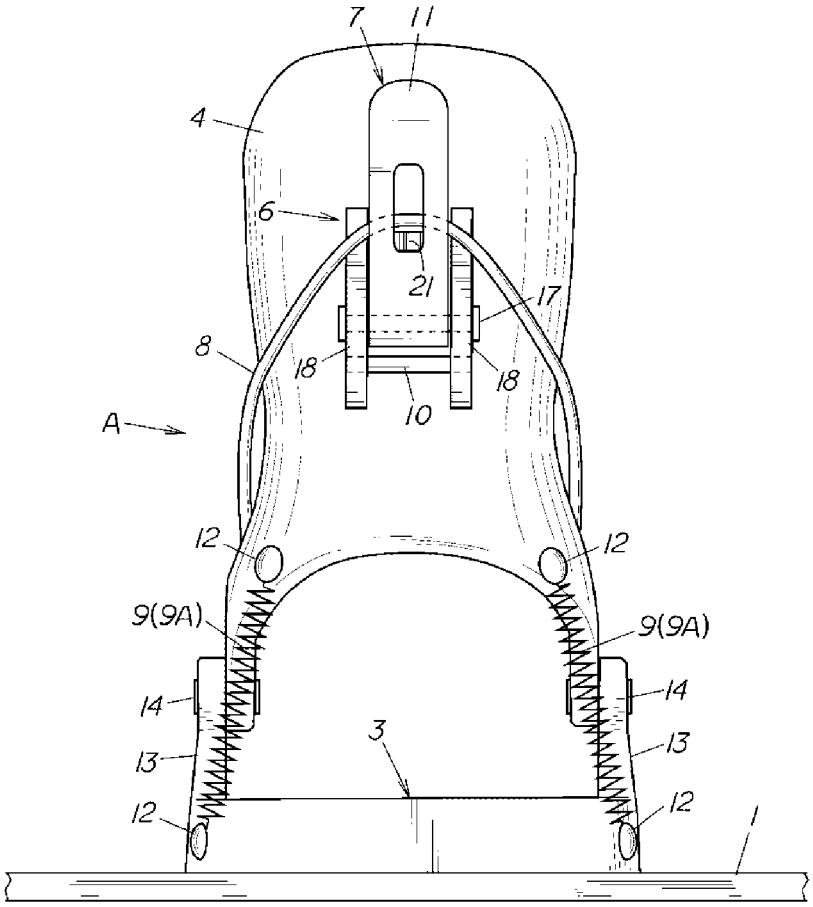
FIG. 3 is a rear surface view illustrating the locked state of the highback of example 1.

As shown in FIGS. 1 to 3, the binding A uses a well-known rearward-tiltable type highback 4 (a type in which the highback 4 is tilted rearward to allow the boot 2 to be dismounted from the base section 3) composed of a base section 3 attached to the upper surface of a snowboard 1 and on which the boot 2 can be mounted, a highback 4 pivotably mounted on a rear part of the base section 3 and capable of rotating in the longitudinal direction with respect to the base section 3, a strap 5 provided in a more front-side position of the base section 3 than the highback 4, and an unlockable lock mechanism 6 for locking the highback 4 in a state in which rearward rotation is impossible.

Figure 5:
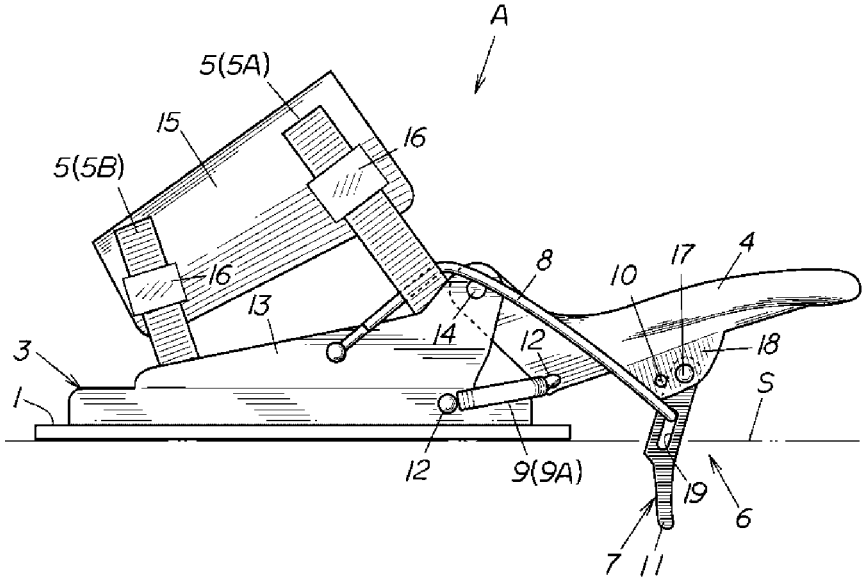
FIG. 5 is a side view illustrating the state in which the highback of example 1 has been rotated rearward and the lock lever has been placed in contact with the surface of the snow.

More specifically, the base section 3 has an attachment wall section 13 erectly disposed on both the left and right sides as shown in FIGS. 2 and 3, the lower part on both sides of the highback 4 are rotatably and pivotably mounted on the rear end section of the attachment wall section 13 to thereby allow pivoting in the longitudinal direction with respect to the base section 3 between a state in which at least the highback 4 has been tilted forward to the base section 3 and a state in which the highback has been tilted to a near horizontal orientation rearward to the base section 3 (see FIG. 5), and the state shown in FIG. 5 is the rearward-rotation-limit position of the highback 4.

An ankle strap 5A serving as the strap 5 of the attachment wall section 13 is rotatably and pivotably mounted in a position below a pivot-mounting section 14 of the highback 4, a toe strap 5B used as the strap 5 is rotatably and pivotably mounted on the front end part of the attachment wall section 13, and a shell portion of the boot 2 is furthermore pressed into the ankle strap 5A and the toe strap 5B and a pressing member 15 for restraining is provided in a spanned state.

A ratchet mechanism 16 is provided to the ankle strap 5A as well as the toe strap 5B, and the degree of pressing (degree of fastening) on the boot 2 by the pressing member 15 can be adjusted.

The lock mechanism 6 has a lock lever 7 rotatably provided to the rear surface section of the highback 4, and a connecting cord 8 provided so as to span between the lock lever 7 and the base section 3.

The lock lever 7 is formed in a strip shape, the tip part thereof being a tip operation part 11, and the base end part being rotatably and pivotably mounted between attachment pieces 18 protruding rearward in left and right positions in about the center of the rear surface section of the highback 4.

The lock lever 7 has a through-hole 19, through which a wire 8 used as the connection cord 8 is inserted, formed between the facing side surfaces of the lock lever, and both ends of the wire 8 inserted through the through-hole 19 are secured in a position between the pivot-mounting section of the ankle strap 5A and the pivot-mounting section of the toe strap 5B of the attachment wall section 13.

When the highback 4 has been brought substantially upright with respect to base section 3 and the lock lever 7 is rotatably operated and thereby made to extend along the rear surface section of the highback 4, the wire 8 is tensioned and the highback 4 is placed in a locked state incapable of rearward rotation, as shown in FIG. 2. When the lock lever 7 is rotatably operated in this locked state and thereby erected rearward from the rear surface section of the highback 4, the wire 8 loosened, as indicated by the two-dot-dash line in FIG. 2, and the highback 4 enters an unlocked state that allows rearward rotation. Reference numeral 21 in the drawing is a tension-adjusting screw of the wire 8.

An engagement projection 20 is provided to the base end section of the lock lever 7 as well as to the rear surface section of the highback 4 between the attachment pieces 18, and when the lock lever 7 is extended along the rear surface section of the highback 4 (when placed in a locked state), the engagement projection 20 on the highback 4 side rides over the engagement projection 20 on the lock lever 7 side and the locked state is maintained. Also, applying force to rotatably operate the lock lever 7 rearward from the locked state causes the engagement projection 20 on the lock lever 7 side to ride over the engagement projection 20 on the highback 4 side and produce an unlocked state.

The present example is configured such that, in the known snowboard binding A described above, a pin 10 serving as the lever-holding body 10 is provided so as to span between the left and right attachment pieces 18 further downward than the pivot-mounting section 17 of the lock lever 7, and when the lock lever 7 rotated rearward from the rear surface section of the highback 4 makes contact with the pin 10, the lock lever 7 has an orientation erected rearward from the rear surface section of the highback 4 and is restricted from rotating further downward.

Figure 4:
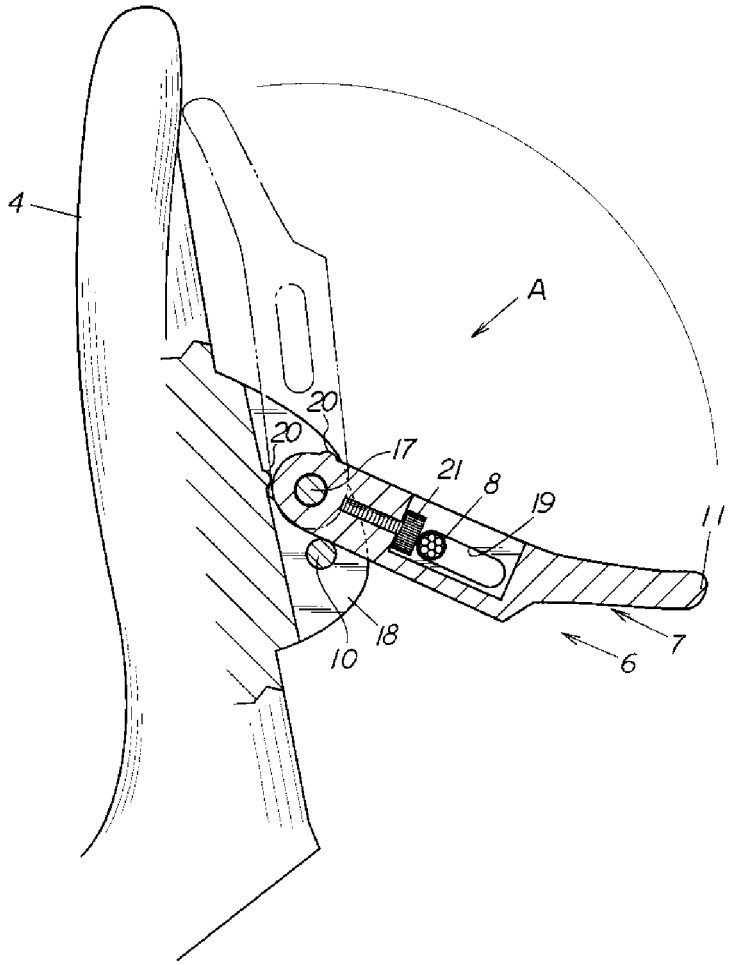
FIG. 4 is a view illustrating the operation of the lock lever of example 1.

In other words, the lock lever 7 of the present example is capable of rotatably moving between a position extended along the rear surface section of the highback 4 and a position in contact with the pin 10 and erect with respect to the rear surface section of the highback 4 (see FIGS. 2 and 4).

When the highback 4 arrives at the rearward-rotation-limit position from near the rearward-rotation-limit position (arrives in at an orientation nearly horizontal), the lock lever 7 held by the pin 10 in an orientation of projecting from the rear surface section of the highback 4 is configured so that the tip operation part 11 protrudes downward (is suspended down) from the rear surface section of the highback 4 which has become horizontal (see FIG. 5).

In the present example, an urging body 9 for rotatably urging the highback 4 rearward is provided to the highback 4, and when the lock lever 7 of the lock mechanism 6 is placed in an unlocked state by the rotatable urging of the urging body 9, the highback 4 automatically rotates rearward.

Specifically, the urging body 9 is a coil spring 9A having tensile elasticity, and the coil spring 9A is provided so as to span between the highback 4 and the base section 3.

The coil spring 9A is provided with an attachment ring 12 serving as the attachment section 12 at both end parts thereof, a machine screw or the like is inserted through the attachment ring 12 to attach one end of the coil spring 9A in a position near the lower part of the rear surface section of the highback 4, and the other end of the coil spring 9A is attached to a position near the rear part of the side surface section of the base section 3.

Two coil springs 9A are provided, one between the left side surface section of the base section 3 and the left side position of the rear surface section of the highback 4, and one between the right side surface section of the base section 3 and the right side position of the rear surface section of the highback 4. The coil spring 9A elongates when the highback 4 has become substantially upright in relation to the base section 3, and has a length dimension that generates a return urging force. When the lock lever 7 of the lock mechanism 6 is placed in an unlocked state, the rotational urging force of the coil spring 9A immediately acts on the highback 4 and the highback 4 automatically rotates rearward.

When the highback 4 arrives at the rearward-rotation-limit position or near the rearward-rotation-limit position due to the rotational urging of the urging body 9 (coil spring 9A), the connecting cord 8 (wire 8) is tensioned, the orientation of the lock lever 7 projecting from the rear surface section of the highback 4 is held in place, and the lock lever 7 in the projecting orientation protrudes downward from the rear surface section of the highback 4, which has become substantially horizontal.

The lock lever 7 of the present example is further described below. When the highback 4 has arrived at the rearward-rotation-limit position or near the rearward-rotation-limit position due to the rotational urging of the coil spring 9A and the lock lever 7 has protruded downward, the lock lever assumes the form of a band plate of such length that the tip operation part 11 protrudes downward further below the lower surface of the snowboard 1 (see FIG. 5). In other words, the lock lever 7 makes contact with the snow surface S so as to pierce the snow surface S below the snowboard 1, and thereby demonstrates the effect of preventing the snowboard 1 (snowboard binding A) from sliding along the snow surface S.

Therefore, in accordance with the present example configured in the manner described above, when the lock lever 7 is rotatably operated to the unlocked state in order to remove the front foot (boot 2), the highback 4 automatically rotates rearward and the lock lever 7 makes contact with (pierces) the snow surface S, and effect of preventing the snowboard 1 from sliding is demonstrated.

When the front foot (boot 2) is to be mounted again, the boot 2 is placed on the base section 3, the highback 4 is thereafter rotatably operated forward against the urging force of the urging body 9 and made to line up with the rear section of the boot 2. The lock lever 7 is rotatably operated and set in a locked state, and the lock lever 7 is therefore separated from the snow surface S and the slide-preventing state is released.

The binding A of the present embodiment can also be used as a binding for mounting the rear foot, but in such a case, the slide-preventing effect is demonstrated when the rear foot is removed from the binding in order to perform a skating action. Therefore, the binding is used for mounting the front foot.

Example 2

Example 2 of the present invention is described in detail below.

The present example is a case of a stopper device for a snowboard binding capable of being attached (retrofitted) to the known binding A described in detail in example 1. Specifically, the configuration is provided with the urging body 9 (coil spring 9A) and the lever-holding body 10 (pin 10) shown in example 1.

When the urging body 9 and the lever-holding body 10 are attached to the highback 4, the highback 4 automatically rotates rearward by the urging force of the urging body 9 when the lock lever 7 of the lock mechanism 6 has been placed in an unlocked state. When the highback 4 arrives at the rearward-rotation-limit position or near the rearward-rotation-limit position, the projecting orientation of the lock lever 7 from the rear surface section of the highback 4 is held by the tension of the connecting cord 8 and the orientation holding effect of the lever-holding body (pin 10), and the lock lever 7 in the projecting orientation makes contact with the snow surface S below the snowboard 1 and demonstrates a slide-preventing effect.

The urging body 9 and the lever-holding body 10 can be attached to the binding A using the same process as example 1 by, e.g., the user or a professionally skilled practitioner.

The details of the present example are repetitions of the description of example 1 and are therefore omitted. Also, a retrofitting device that uses configurations of examples 3 to 5 below may also be used.

In the case of a retrofitting device such as the present example, a replacement lever having sufficiently length to replace the lock lever 7 can be provided as a countermeasure to the case in which the length of the lock lever 7 is insufficient for demonstrating a slide-preventing effect on the snow surface S. Alternatively a lever attachment that can be mounted on the lock lever 7 may be provided.

Example 3

Figure 6:
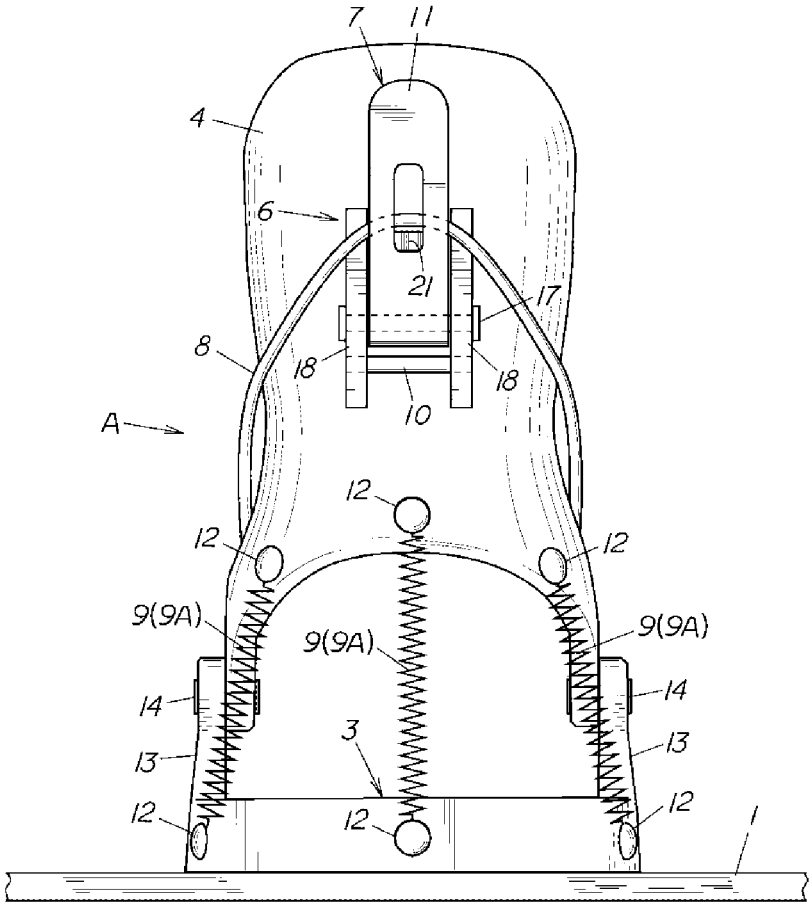
FIG. 6 is a rear surface view illustrating the locked state of the highback of example 3.

Example 3 of the present invention is described in detail below with reference to FIG. 6.

The present example is a case in which a coil spring 9A serving as the urging body 9 in example 1 also spans between the center position near the lower part of the rear surface section of the highback 4 and the center portion of the rear section of the base section 3, and the highback 4 is rotatably urged rearward by three coil springs 9A.

A single coil spring 9A serving as the urging body 9 may be provided so as to span between the highback 4 and the base section 3, or four or more coil springs may be provided in the spanned state.

The configuration is otherwise the same as example 1.

Example 4

Figure 7:
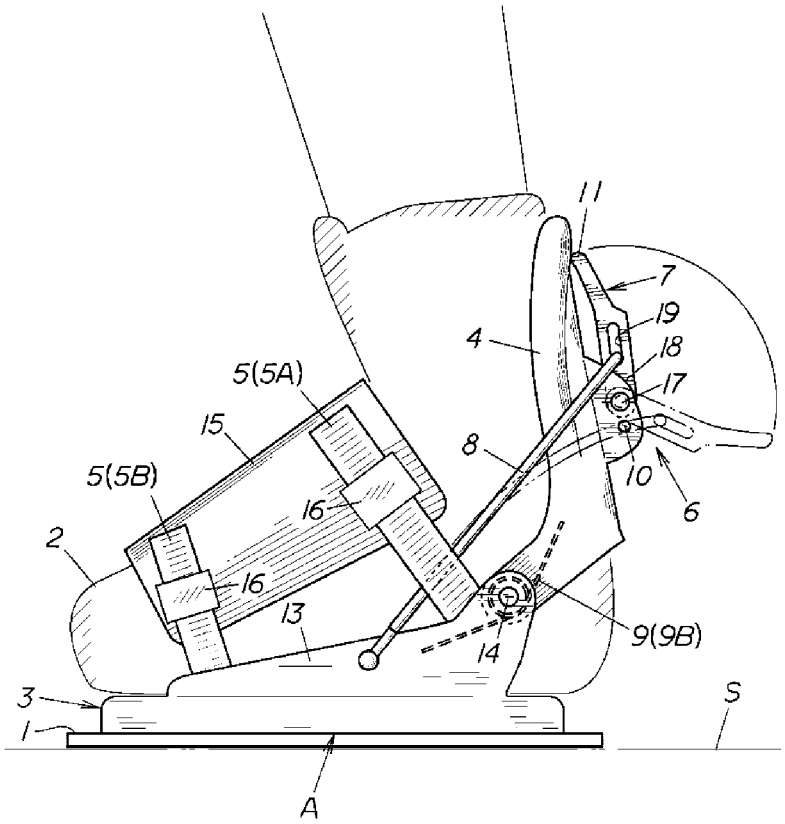
FIG. 7 is a side view illustrating the worn-state of the boot of example 4.

Example 4 of the present invention is described in detail below with reference to FIG. 7.

The present example is a case in which the configuration of the urging body 9 is different from that in example 1.

Specifically, the urging body 9 of the present example is a torsion spring 9B.

More specifically, the torsion spring 9B is supported about the pivot-mounting section 14, one end of the torsion spring 9B interlocks with the highback 4, the other end interlocks with the base section 3, and the torsion spring 9B rotatably urges the highback 4 rearward.

The torsion spring 9B may be provided to both the left and right pivot-mounting sections 14, or to only one of the pivot-mounting sections 14. The torsion spring 9B may be used in combination with the coil spring 9A indicated as the urging body 9 in example 1.

The configuration is otherwise the same as example 1.

Example 5

Figure 8:
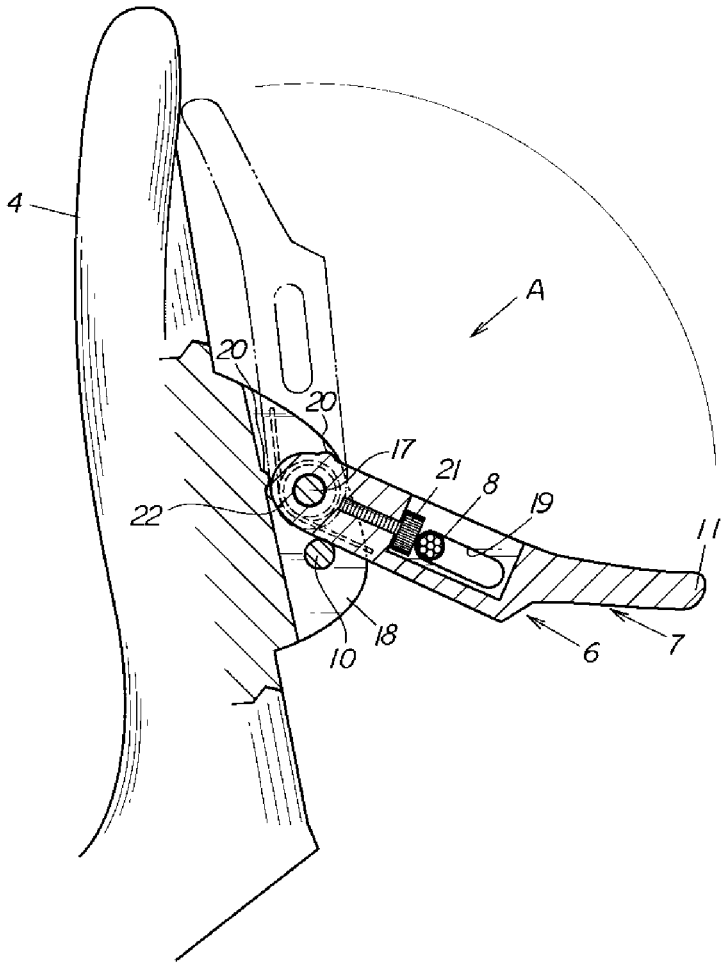
FIG. 8 is a view illustrating the operation of the lock lever of example 5.

Example 5 of the present invention is described in detail below with reference to FIG. 8.

The present example is a case in which a lever-urging body 22 for rotatably urging the lock lever 7 rearward to be erected rearward from the rear surface section of the highback 4 is provided to the lock lever 7 in example 1.

Specifically, the lever-urging body 22 is a torsion spring 22. The torsion spring 22 is supported about the pivot-mounting section 17. For example, one end of the torsion spring 22 interlocks with the lock lever 7, the other end interlocks with the rear surface section of the highback 4 or the attachment piece 18, and the torsion spring 22 rotatably urges the lock lever 7 rearward.

The lever-urging body 22 may be another elastic body other than the torsion spring 22.

The configuration is otherwise the same as example 1.

The present invention is not limited to examples 1 to 5; the specific configuration of constituent features may be designed, as appropriate.

KEY

1 Snowboard
2 Boot
3 Base section
4 Highback
5 Stopper
6 Lock mechanism
7 Lock lever
8 Connecting cord
9 Urging body
10 Lever-holding body
11 Tip operation part
12 Attachment section
A Snowboard binding
S Snow surface

The invention claimed is:

1. A snowboard binding comprising a base section attached to a snowboard and allowing a boot to be mounted thereon, a highback pivotably mounted on a rear part of the base section and capable of rotating in the longitudinal direction with respect to the base section, a strap provided in a position of the base section further frontward than the highback, and an unlockable lock mechanism for locking the highback in a state in which rearward rotation is impossible, the lock mechanism having a lock lever rotatably provided to a rear surface section of the highback and a connecting cord provided so as to span between the lock lever and the base section, and being configured so that when the lock lever is extended along the rear surface section of the highback by a rotating operation, the connecting cord is tensioned and the highback is placed in a locked state in which rearward rotation is impossible, and so that when the lock lever in the locked state is caused to project rearward from the rear surface section of the highback by the rotation operation, the connecting cord slackens and the highback is placed in an unlocked state in which rearward rotation is possible; the snowboard binding characterized in that an urging body for rotatably urging the highback rearward is provided to the highback, and when the lock lever of the lock mechanism is placed in an unlocked state by the rotational urging of the urging body, the highback automatically rotates rearward, and so that when the highback arrives at the rearward-rotation-limit position or near the rearward-rotation-limit position, the connecting cord is tensioned, the orientation at which the lock lever projects from the highback rear surface section is maintained, and the lock lever in the projecting orientation makes contact with the snow surface below the snowboard to bring about a slide-preventing effect.

2. The snowboard binding according to claim 1, characterized in that the lock lever is formed into a shape having a tip operation part that allows the lock lever to be rotatably operated, and is formed into a shape in which the tip operation part of the lock lever protrudes below the lower surface of the snowboard and makes contact with the snow surface below the snowboard when the highback arrives at the rearward-rotation-limit position or near the rearward-rotation-limit position due to the rotational urging of the urging body with the lock lever in a state of being caused to project rearward from the rear surface of the highback.

3. The snowboard binding according to claim 2, characterized in being configured so that a lever-holding body for holding the unlocked lock lever in an orientation in which the lock lever is caused to project rearward from the rear surface section of the highback is provided to the highback, and so that the tip operation part of the lock lever held in the orientation of projecting from the rear surface section of the highback by the lever-holding body protrudes downward when the highback arrives at the rearward-rotation-limit position or near the rearward-rotation-limit position due to the urging body.

4. The snowboard binding according to claim 3, characterized in being configured so that that the urging body is provided so as to span between the highback and the base section, and the urging body rotatably urges the highback rearward.

5. The snowboard binding according to claim 1 or 2, characterized in being configured so that the urging body is provided so as to span between the highback and the base section, and the urging body rotatably urges the highback rearward.

* * * * *